US006435269B1

(12) United States Patent
Hancock

(10) Patent No.: US 6,435,269 B1
(45) Date of Patent: Aug. 20, 2002

(54) HEAT EXCHANGER WITH INTERTWINED INNER AND OUTER COILS

(76) Inventor: Stephen S. Hancock, c/o The Trane Company, La Crosse, WI (US) 54601

( * ) Notice: Subject to any disclaimer, the term of this patent is extended or adjusted under 35 U.S.C. 154(b) by 0 days.

(21) Appl. No.: 09/443,607

(22) Filed: Nov. 19, 1999

(51) Int. Cl.[7] ..... F28F 9/26; F28F 13/12

(52) U.S. Cl. ..... 165/144; 165/125; 165/145; 165/163

(58) Field of Search ..... 165/144, 145, 165/156, 163, 125, 169

(56) References Cited

U.S. PATENT DOCUMENTS 2,456,564 A * 12/1948 Muller ..... 165/163 X
3,411,574 A * 11/1968 De Vries et al. ..... 165/145
3,809,061 A * 5/1974 Gerstmann ..... 165/163 X
4,114,686 A * 9/1978 Mueller et al. ..... 165/163 X
4,535,838 A 8/1985 Gray et al.
4,554,968 A 11/1985 Haas ..... 165/144
4,557,323 A * 12/1985 Hardy et al. ..... 165/163
4,727,737 A 3/1988 Bryant
4,805,283 A 2/1989 McManus
5,214,938 A * 6/1993 Kennedy et al. ..... 62/515
5,737,828 A 4/1998 Barnes
5,803,163 A * 9/1998 Goulet ..... 165/163 X
5,896,659 A 4/1999 Barnes

* cited by examiner

*Primary Examiner*—Leonard Leo
(74) *Attorney, Agent, or Firm*—William J. Beres; William O'Driscoll

(57) ABSTRACT

A double-row heat exchanger coil includes intertwined inner and outer loops. The loops are situated to allow one continuous coil to be wound in an uninterrupted coiling operation, and later cut at several locations to create several individual circuits that are readily connected to each other in a parallel flow relationship.

24 Claims, 4 Drawing Sheets

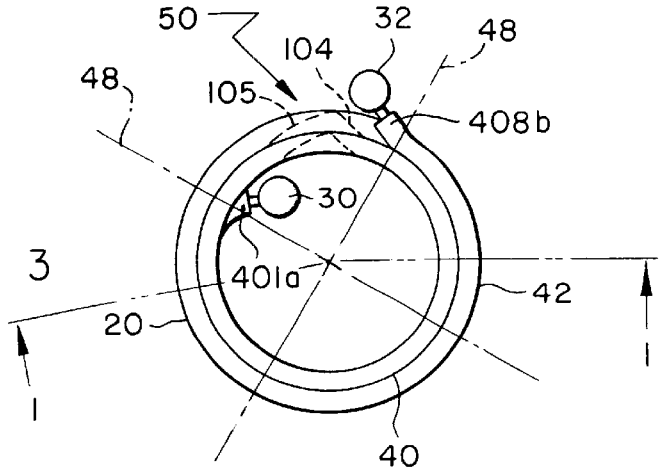
FIG. 3
FIG. 1
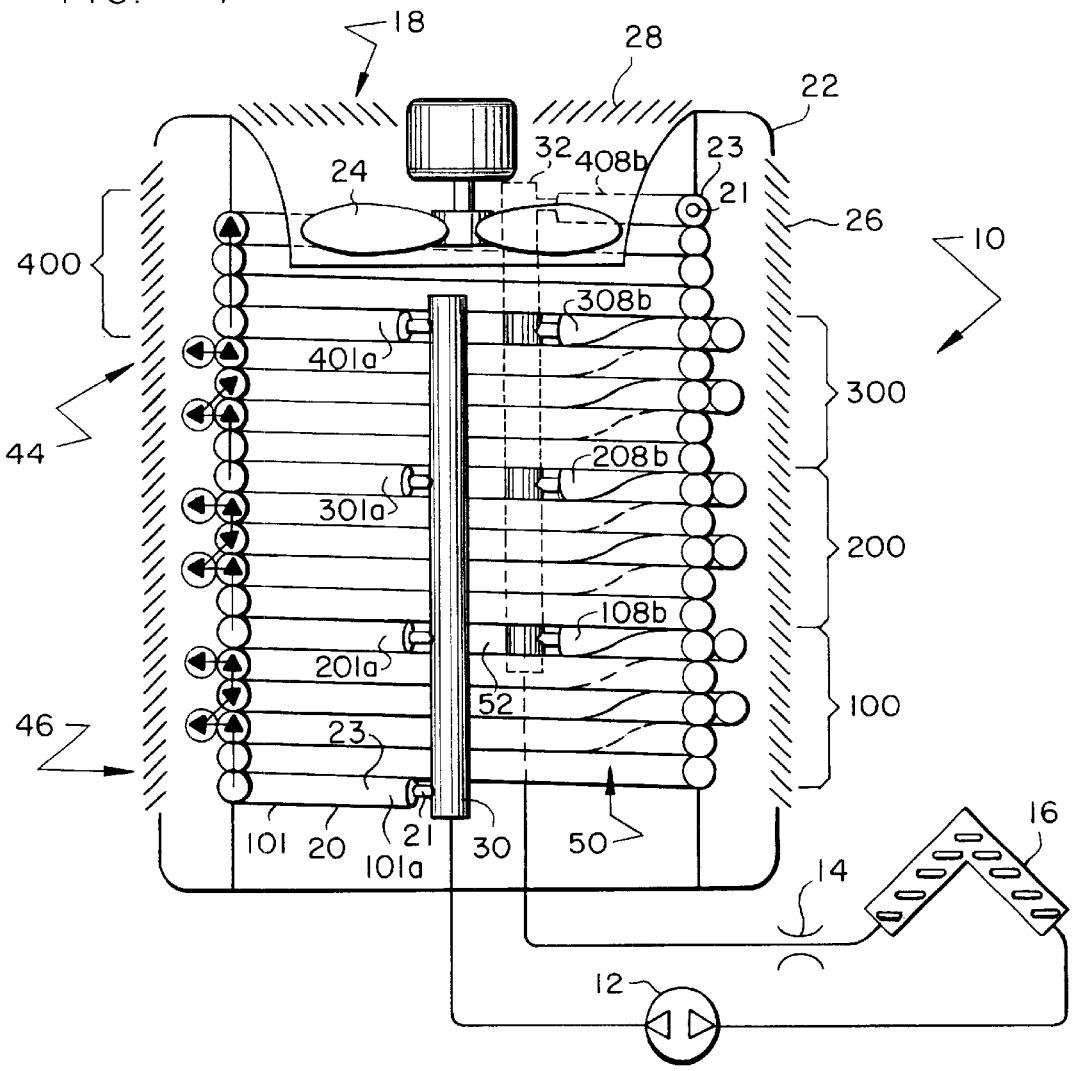

HEAT EXCHANGER WITH INTERTWINED INNER AND OUTER COILS

BACKGROUND OF THE INVENTION

1. Field of the Invention

The subject invention generally pertains to a refrigerant system and more specifically to the coil configuration of a wound heat exchanger coil.

2. Description of Related Art

Many air conditioning systems, such as split-systems and/or heat pumps, fundamentally include an indoor heat exchanger, an outdoor heat exchanger, a compressor and an expansion device that are connected in series to comprise a refrigerant circuit. As the compressor forces refrigerant through the circuit, compression and expansion of the refrigerant respectively raises and lowers the temperature of the refrigerant. The refrigerant then absorbs or expels heat to the external surroundings of the heat exchangers. For example, in a cooling mode, relatively cool, lower pressure refrigerant passing through the indoor heat exchanger (operating as an evaporator) cools the indoor air (directly or via an intermediate fluid), while relatively hot, higher pressure refrigerant delivered to the outdoor heat exchanger (operating as a condenser) expels heat to the outside ambient air (or water). With some systems, generally reversing the direction of part or all of the refrigerant flow through the circuit places the system in a heating mode to warm the indoor air or temporarily places the system in a defrost mode. In the defrost mode, the circuit directs relatively hot, higher pressure refrigerant to the heat exchanger that was previously operating as the evaporator, and thus thaws frost that may have accumulated on that heat exchanger.

Outdoor heat exchangers often comprise several wound tubes to provide several coiled circuits that are arranged directly above each other so that the coiled tubes become the perimeter of a larger tubular assembly. Two vertical manifolds connecting the ends of each wound tube places the coiled circuits in parallel flow relationship with each other. The tubes usually have external fins (e.g., spine fins) to promote heat transfer and thus improve the overall efficiency of the air conditioning system.

However, as consumers demand higher efficiencies, the size of the outdoor coil (i.e., the tubular assembly) increases. To keep the overall size of the outdoor coil within a reasonably sized package, sometimes a second coil is added to the outdoor coil. The second coil can be wound around the first, as disclosed in U.S. Pat. No. 4,554,968, or the second coil can be slightly smaller than the first and slipped inside the outer one. Either way provides an outdoor heat exchanger with two rows of coils: an inner one and an outer one.

Although a conventional heat exchanger coil with two rows is quite efficient, several problems are associated with such a coil. First, some double-row coils require a tubing connection, or jumper, to connect an inner coil to an outer one. Such a connection is commonly made by cutting both coils, pulling part of the inner coil through the outer one, and then connecting the two with a U-shaped return bend. When the return bend is copper and the coil tubing is aluminum, a transition joint may also be necessary. Each connection adds assembly time and increases the likelihood of leaks. Moreover, wherever the coil is cut to attach either a manifold or a jumper, a hole is left through which air flows, bypassing the coil and avoiding heat exchange.

Second, inner coils are typically large and unwieldy, which make them difficult to insert into an outer coil.

Third, the coil configuration of conventional double-row coils tends to dictate the location of the manifolds (e.g., both on the inside, both on the outside, or one on each side), regardless of other design criteria. However, it may be preferable to have the manifold in another location for other reasons, such as ease of assembly (e.g., both manifold on the outside) or compactness (e.g., both manifolds on the inside).

Fourth, for many double-row coils most of the inner loops (i.e., inner passes) are closer to the vapor connections with respect to refrigerant flow than the liquid connections, as is the case with the U.S. Pat. No. 4,554,968. The terms, "vapor connection" and "liquid connection" are relative in that the refrigerant normally tends more toward the liquid state at the liquid connection than at the vapor connection. However, the refrigerant is not necessarily a liquid, gas, or any particular combination of the two at either connection. For example, an individual wound tube of the outdoor coil runs between a vapor connection at one manifold and a liquid connection at another manifold. When the outdoor coil functions as a condenser in a system operating in a cooling mode, the refrigerant tends to give off heat and condense as it flows from the vapor connection to the liquid connection. And for that same outdoor coil functioning as an evaporator when the system is in a heating mode, the refrigerant tends to a more gaseous or superheated state as the refrigerant absorbs heat upon flowing in reverse from the liquid connection to the vapor connection. With the system operating in the heating mode, the loops near the vapor connection typically convey superheated refrigerant. The problem here is that significantly more coil area is required to reach a given level of superheat if the superheating passes are on the inner row, since the difference between the refrigerant temperature and the outdoor air temperature here is slight. Also, since a large portion of the coil's refrigerant-side pressure drop occurs in the superheating region, more coil area in superheat means more refrigerant-side pressure drop and worse performance. Nonetheless, of the five circuits of the coil disclosed in the U.S. Pat. No. 4,554,968, only one (the bottom one) transits from an outer loop to an inner one, and then it only transits once.

Fifth, in manufacturing a multi-circuit, coiled heat exchanger, it is often preferable to first wrap the entire coil as a single circuit and later cut the continuous coil into smaller circuits. This avoids slowing the coiling process by having to repeatedly interrupt a power coiler, such as those similar to the one disclosed in U.S. Pat. No. 5,737,828. However such an approach is not always practical, especially when the coil configuration fails to position the liquid loop of a first circuit closer to the vapor loop of an adjacent circuit than to the vapor loop of the first circuit, as appears to be the case in the U.S. Pat. No. 4,554,968. Placing the liquid loop of a first circuit adjacent or near the vapor loop of an adjacent circuit allows two ends of each loop to be created with a single tube cut.

Just as the terms, "vapor connection" and "liquid connection," are used in a relative sense, other terms such as "vapor loop," "vapor manifold," "vapor connection," "liquid loop," "liquid manifold," "liquid connection," etc., are also used relatively in that the refrigerant tends more toward the liquid state in the liquid manifold, liquid loop, and liquid connection than in the vapor manifold, vapor loop, and vapor connection respectively.

A sixth problem with many conventional double-coil heat exchangers is that most of the hot discharge refrigerant gas used for defrost cools significantly upon first passing through the inner coil before reaching the outer one. For example, the U.S. Pat. No. 4,554,968 appears to show refrigerant in a defrost cycle having to pass through at least three inner loops before transiting to an outer loop. But often most of the frost tends to accumulate on the outer coil where the outdoor air enters the coil. Consequently, hot defrost refrigerant having to first pass through several inner loops before reaching an outer one tends to extend the defrost cycle and degrade the heating efficiency of the system.

Seventh, the maximum outdoor air velocity across a heat exchanger having a uniform distribution of coils usually occurs near the fan inlet, somewhere between the top and bottom of the coil. The airflow velocity at the top and bottom of the coil is generally lower, and thus those areas are not used as effectively as the area near the fan inlet.

SUMMARY OF THE INVENTION

To overcome the numerous problems and limitations of conventional heat exchangers with two rows of coils, it is an object of the invention to intertwine the inner and outer coils.

Another object of the invention is to provide a double-coil heat exchanger with several parallel-flow circuits that can be wound in a single, continuous winding operation and yet still position vapor and liquid connections at strategic locations, e.g., a liquid loop of a first circuit being closer to a vapor loop of an adjacent circuit than a vapor loop of the first circuit.

Another object is to provide a double-coil heat exchanger with several parallel-flow circuits that can be wound in a single, continuous winding operation, while allowing a generally single tube cut to provide both a vapor and liquid connection that are cicumferentially positioned within the same quadrant of a coil.

Yet another object is to provide a double-coil heat exchanger with several vapor and liquid connections that are readily positioned for connection to two manifolds at optional locations: both inside an inner coil, both outside an outer coil, or one inside and one outside.

A further object is to employ an inner or outer loop to obstruct an otherwise open hole at a tubing connection.

A still further object is to intertwine the inner and outer coils of a heat exchanger to alternate the defrost and/or superheating passes.

Another object of the invention is to provide a double-coil heat exchanger with a single row of coils at the upper and/or lower end of the heat exchanger to more evenly distribute the airflow across the coils.

Another object is to interrupt the second row of a double-coil heat exchanger at a vapor pass (i.e., loop or pass adjacent a vapor connection) to maximize the vapor loop's exposure to airflow.

Another object is to provide a double-coil heat exchanger having a minimum number of jumpers, such as couplings and return bends.

Yet another object is to provide a double-coil heat exchanger while avoiding the challenge of slipping one coil inside an outer one.

In some embodiments, another object is to vertically stagger the inner and outer loops of a double-coil heat exchanger to minimize the overall size of the heat exchanger.

In some embodiments, another object is to vertically align the inner and outer loops of a double-coil heat exchanger, so that when winding both coils in a single operation, the inner loops firmly support the outer loops. This prevents the outer loops from squeezing between the inner loops which tends to happen when the inner and outer loops are vertically staggered.

The present invention provides a heat exchanger coil. The coil comprises a circuit-A extending in a coiled configuration from a vapor loop-A to a liquid loop-A and being distributed to create a plurality of inner A-loops and a plurality of outer A-loops. The circuit-A repeatedly transits from the plurality of outer A-loops to the plurality of inner A-loops, as the circuit-A runs from the vapor loop-A to the liquid loop-A.

The present invention additionally provides a heat exchanger coil. The coil comprises a circuit-A extending from a vapor loop-A to a liquid loop-A and being distributed to create a plurality of inner A-loops and a plurality of outer A-loops; and a circuit-B in parallel-flow relationship with said circuit-A and extending from a vapor loop-B to a liquid loop-B. The circuit-B is distributed to create a plurality of inner B-loops and a plurality of outer B-loops with the liquid loop-A being closer to the vapor loop-B than the vapor loop-A.

The present invention also provides a refrigerant system. The system comprises a refrigerant compressor; a flow restriction; an indoor heat exchanger; an outdoor heat exchanger that includes a vapor manifold and a liquid manifold that place the outdoor heat exchanger in series flow relationship with the refrigerant compressor, the flow restriction and the indoor heat exchanger. The system also comprises a circuit-A borne by the outdoor heat exchanger and extending from a vapor loop-A to a liquid loop-A with the vapor loop-A being coupled to the vapor manifold and the liquid loop-A being coupled to the liquid manifold. The circuit-A is distributed to create a plurality of inner A-loops and a plurality of outer A-loops and repeatedly transits from the plurality of outer A-loops to the plurality of inner A-loops, as the circuit-A runs from the vapor loop-A to the liquid loop-A. The system also comprises a circuit-B borne by the outdoor heat exchanger and extending from a vapor loop-B to a liquid loop-B with the vapor loop-B being coupled to the vapor manifold and the liquid loop-B being coupled to the liquid manifold to place the circuit-B in parallel flow relationship with the circuit-A. The circuit-B is distributed to create a plurality of inner B-loops and a plurality of outer B-loops with the liquid loop-A being closer to the vapor loop-B than the vapor loop-A. The circuit-B repeatedly transits from the plurality of outer B-loops to the plurality of inner B-loops, as the circuit-B runs from the vapor loop-B to the liquid loop-B.

The present invention further provides a heat exchanger coil comprising: a first vertically aligned row of spine fin tubing; a second vertically aligned row of spine fin tubing; and circuiting to repeatedly transit the flow of a fluid between the first and second rows.

These and other objects of the invention are provided by double-coil heat exchanger having inner and outer loops that are intertwined such that the outer loop repeatedly transits to the inner loop.

BRIEF DESCRIPTIONS OF THE DRAWINGS

FIG. 1 is a schematic front view of a refrigerant system with a cross-sectional view taken along line 1—1 of FIG. 3 showing a double-row heat exchanger coil.

FIG. 3 is a top view of a double-row heat exchanger coil.

DESCRIPTION OF THE PREFERRED EMBODIMENT

Figure 2:
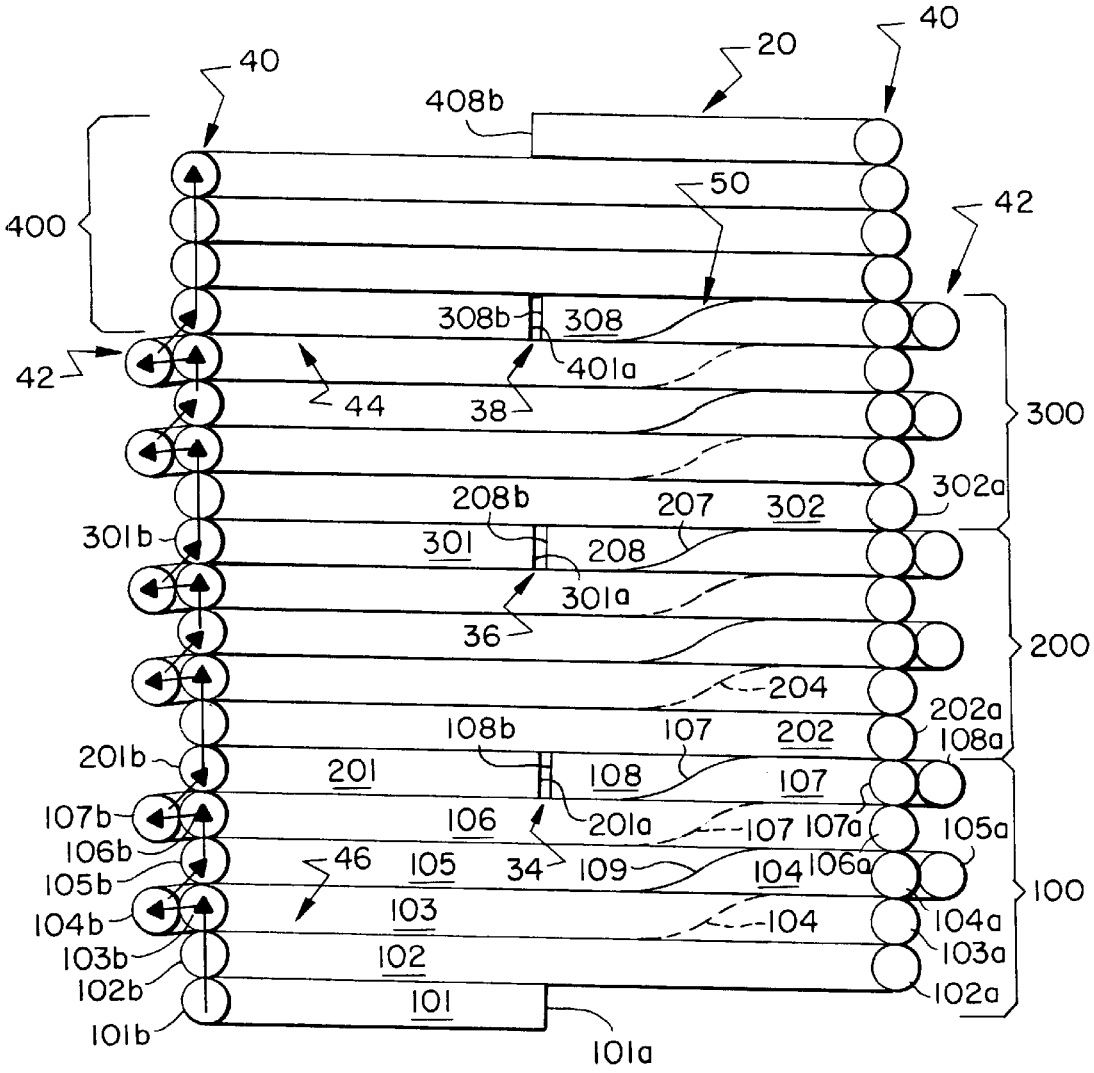
FIG. 2 is a cross-sectional view of a coil taken along line 1—1 of FIG. 3, but prior to the coil being connected to any manifolds.

A refrigerant system 10 of FIG. 1 includes, in series flow relationship, a refrigerant compressor 12; a flow restriction 14, such as an orifice or an expansion valve; an indoor heat exchanger 16 for conditioning the temperature of a comfort zone; and an outdoor heat exchanger 18. Outdoor heat exchanger 18 includes a double-row heat exchanger coil 20 housed within an enclosure 22. The tubing 21 of coil 20 is preferably provided with fins, such as spine fins 23, to enhance heat transfer. A fan 24 draws outside ambient air in through an inlet register 26, across coil 20, and discharges the air out through a discharge register 28. Parts of refrigerant system 10 are schematically illustrated to represent a variety of systems including dual-purpose systems such as a heat pump selectively used for heating or cooling, and systems dedicated for just cooling or just heating.

When system 10 is operating in a cooling mode, i.e., cooling the comfort zone, or defrost mode between heating cycles, compressor 12 discharges relatively hot refrigerant gas into a vapor manifold 30. From vapor manifold 30, the refrigerant travels through, in this example, four coilded circuits 100, 200, 300 and 400 that are connected in parallel-flow relationship with each other. After being cooled and/or condensed by outside ambient air, the refrigerant passes through a liquid manifold 32 and across expansion device 14. Expansion device 14 lowers the pressure and temperature of the refrigerant to provide indoor heat exchanger 16 with refrigerant that cools the comfort zone before returning to the suction side of compressor 12.

When system 10 is operating in a heating mode, compressor 12 discharges relatively hot refrigerant gas through indoor heat exchanger 16, which now functions as a condenser that heats the comfort zone as indoor air cools and/or condenses the refrigerant. From indoor heat exchanger 16, the refrigerant passes across expansion device 14, which expands and cools the refrigerant. The refrigerant then enters liquid manifold 32. From liquid manifold 32, the refrigerant travels through circuits 100, 200, 300 and 400 in a direction opposite that of the cooling mode. After being heated by outside ambient air, the refrigerant (now preferably superheated to protect the compressor) passes through vapor manifold 30 and returns to the suction side of compressor 12.

To address the numerous problems associated with conventional double-row coils, circuits 100, 200, 300 and 400 of outdoor coil 20 are each wound in a unique configuration. Referring to FIG. 2, coil 20 is initially wrapped as a continuous coil about a mandrel and later cut at locations 34, 36, and 38 to create the four individual circuits 100, 200, 300 and 400. Although this is the preferred method, circuits 100, 200, 300 and 400 could also be wound individually, if desired. FIG. 2 shows coil 20 prior to it being connected to manifolds 30 and 32. A process of manufacture is generally described in U.S. Pat. Nos. 5,737,828 and 5,896,659, both to Barnes, both commonly assigned with the present invention, and both incorporated by reference herein.

Circuit 100 is wound to create several loops that are identified in sequential order as loops 101, 102, 103, 104, 105, 106, 107, 108 and 109. The loops are situated to create several inner passes such as inner loops 40 as well as some outer passes such as outer loops 42. Circuit 100 extends between a vapor connection lOla at one end and a liquid connection 108*b* at an opposite end. From vapor connection 101*a*, circuit 100 runs sequentially through a vapor loop 101, a point 101*b*, a point 102*a*, loop 102, a point 102*b*, a point 103*a*, loop 103, a point 103*b*, a point 104*a*, loop 104, transits out to outer loops 42, a point 104*b*, a point 105*a*, loop 105, transits in to inner loops 40, a point 105*b*, a point 106*a*, loop 106, a point 106*b*, a point 107*a*, loop 107, transits back out to outer loops 42, a point 107*b*, a point 108*a*, liquid loop 108, transits to inner loops 40, and to liquid connection 108*b*.

Circuits 200 and 300 are each wound in fashion similar to that of circuit 100. Circuit 200 runs sequentially from a vapor connection 201*a*, through a vapor loop 201, a point 201*b*, a point 202*a*, a loop 202, and eventually through a liquid loop 208 and a liquid connection 208*b*. In running from vapor connection 201*a* to liquid connection 208*b*, circuit 200 transits twice from outer loops 42 to inner loops 40. Circuit 300 runs sequentially from a vapor connection 301*a*, through a vapor loop 301, a point 301*b*, a point 302*a*, a loop 302, and eventually through a liquid loop 308 and a liquid connection 308*b*.

In some cases, a single-row circuit, such as circuit 400, is added to provide a desired heat transfer capacity or to increase airflow in certain areas. Sometimes it is desirable to improve airflow near an upper portion 44 or a lower portion 46 of the coil, or improve airflow at a vapor loop, such as loops 101, 201, and 301. A single-row circuit can be a single layer of inner loops 40 or outer loops 42. In the embodiment of FIG. 2, circuit 400 is a single layer of inner loops 40 that runs from a vapor connection 401*a* to a liquid connection 401*b*. Circuit 400 is disposed near upper portion 44 and is connected in parallel flow relationship with circuits 100, 200 and 300. However, loops 101 and 102 could also be considered to comprise a single-row circuit having two loops in a single layer and being connected in series-flow relationship with the remainder of circuit 100.

To connect coil 20 of FIG. 2 to manifolds 30 and 32 of FIG. 1, some of the loop ends may need to be trimmed and the fins at each end of circuits 100, 200, 300 and 400 are preferably stripped back. Vapor ends 101*a*, 201*a*, 301*a* and 401*a* are then soldered, brazed or otherwise connected to vapor manifold 30. Likewise, liquid ends 108*b*, 208*b*, 308*b* and 408*b* are connected to liquid manifold 32 to place circuits 100, 200, 300 and 400 in a parallel flow relationship.

Circuits 100, 200, 300 and 400 have several notable features. Liquid connection 108*b* being closer to vapor connection 201*a* than to vapor connection 101*a* allows coil 20 to be wound as a continuous coil with connections 201*a* and 108*b* being produced later with generally one cut. Of course additional cuts or trimming can be made to further offset connections 201*a* and 108*b* from each other if desired. However, as shown in FIG. 3, keeping the liquid and vapor connections and their respective liquid and vapor manifolds 32 and 30 within the same quadrant 48 saves tubing material. The same applies to connections 301*a* and 208*b*, as well as 401*a* and 308*b*.

The locations of the liquid and vapor connections allow circuits 100, 200, 300 and 400 to be readily connected to manifolds 30 and 32 without return bends and other related components. Having the loops of circuits 100, 200 and 300 repeatedly transiting between inner loops 40 and outer loops 42 advantageously shifts the location of the defrost and superheating passes.

A circumferential location 50 at which many of the loops, such as loops 104, 107, 204 and 207 transit between inner and outer loops 40 and 42 can vary from the positions illustrated. For example, loop 107 transits outward just to the right of connection 108*b* not only for the illustrative purpose of more clearly showing connections 108*b* and 201*a*, but also to allow connection 108*b* to be easily bent in or out for ready connection to a manifold on either side of coil 20. In some cases, however, it may be preferable to delay the outward shift of loop 107, so that it occurs to the left of connection 201*a*. Loop 107 could then serve as an inner loop that could block air from freely blowing by a hole 52 or gap that may otherwise exist between connections 108*b* and 201*a*.

Figure 4:
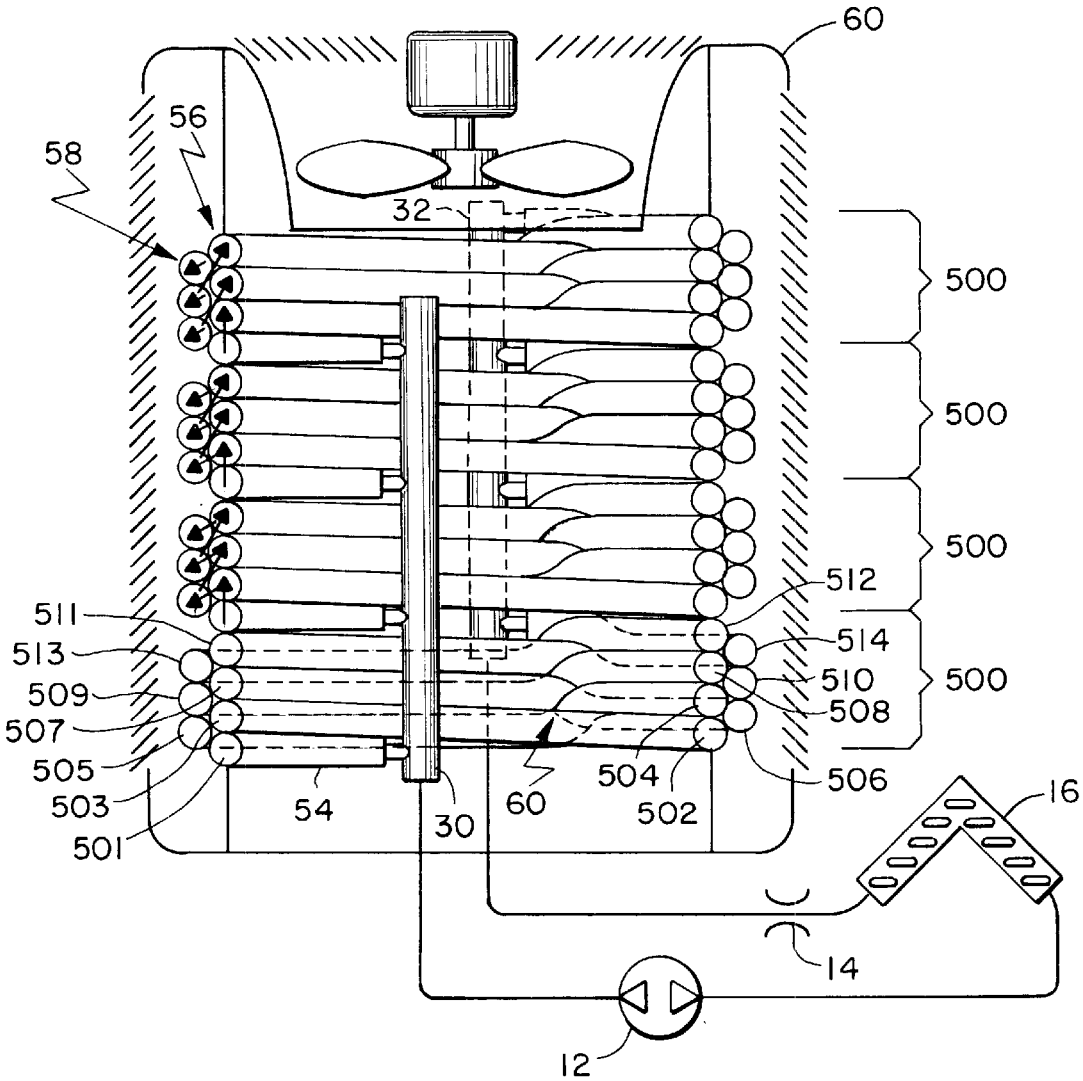
FIG. 4 is similar to FIG. 1, but with the loops of a double-row heat exchanger coil being vertically staggered.
Figure 5:
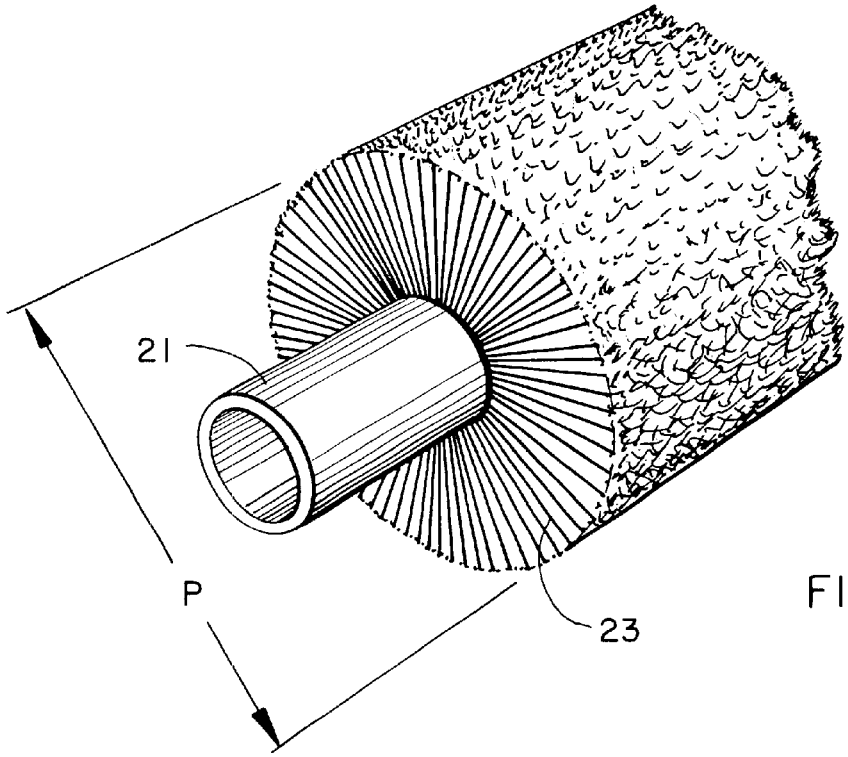
FIG. 5 is a drawing of a spine fin tubing as used in accordance with the present invention.

To radially support outer loops 42 with inner loops 40, the two sets of loops are vertically aligned with each other. However, in some cases there may be an advantage to vertically staggering them. For example, a coil 54 of FIG. 4 includes inner and outer loops 56 and 58 that are vertically staggered to enhance heat transfer and to minimize the size of an enclosure 60. Coil 54 includes four circuits 500 each of which run from vapor manifold 30 to liquid manifold 32 in sequence through points 501, 502, 503, 504, 505, 506, 507, 508, 509, 510, 511, 512, 513 and 514. In running between manifolds 30 and 32, the loops of each circuit repeatedly transit between inner loops 56 and outer loops 58, Just as with coil 20, a circumferential location 60 at which many of the loops transit between inner and outer loops 56 and 58 can vary.

What has been described is a heat exchanger coil including a first vertically aligned row of spine fin tubing (such as inner loop 40), a second vertically aligned row of spine fin tubing (such as outer loop 42), and circuiting to repeatedly transit the flow of a fluid between the first and second rows. In the heat exchange coil, the circuiting moves the fluid in a first vertical direction, and the circuitry does not move the fluid in a vertical direction substantially opposite the first vertical direction. The heat exchange coil is wound, and the first and second rows include a plurality of spiral loops in a pattern. The pattern has a fluid flow sequence of three spiral loops 101*b*, 102*b*, 103*b* in the first vertical row, one spiral loop 104*b* in the second vertical row, two spiral loops 105*b*, 106*b* in the first vertical row, and one spiral loop 107*b* in the second vertical row. The sequence then repeats. Also, the spiral loops in the second vertical row have a greater diameter than the spiral loops in the first vertical row. Although the invention is described with respect to a preferred embodiment, various modifications thereto will be apparent to those skilled in the art. Therefore, the scope of the invention is to be determined by reference to the claims, which follow.

What is claimed is:

1. A heat exchanger coil, comprising a circuit-A extending in a coiled configuration from a vapor loop-A to a liquid loop-A and being distributed to create a greater plurality of inner A-loops of a first width and a lesser plurality of outer A-loops of a second greater width, wherein said circuit-A repeatedly transits between said plurality of outer A-loops and said plurality of inner A-loops, as said circuit-A runs from said vapor loop-A to said liquid loop-A.

2. The heat exchanger coil of claim 1, further comprising a circuit-B in parallel-flow relationship with said circuit-A and extending from a vapor loop-B to a liquid loop-B, said circuit-B being distributed to create a greater plurality of inner B-loops of the first width and a lesser plurality of outer B-loops of the second width, wherein said circuit-B repeatedly transits between said plurality of outer B-loops and said plurality of inner B-loops, as said circuit-B runs from said vapor loop-B to said liquid loop-B.

3. The heat exchanger coil of claim 2, wherein said liquid loop-A is closer to said vapor loop-B than said vapor loop-A.

4. The heat exchanger coil of claim 1, wherein said inner A-loops are vertically staggered relative to said outer A-loops.

5. The heat exchanger coil of claim 2, wherein said circuit-A and said circuit-B are each circumferentially disposed about 360 degrees to encompass four quadrants, wherein said liquid loop-A includes an axial edge-A and said vapor loop-B includes an axial edge-B, and wherein said axial edge-A and said axial edge-B are both situated within one of the four quadrants.

6. The heat exchanger coil of claim 2, wherein said circuit-B includes an intermediate loop-B adjacent vapor loop-B and disposed between vapor loop-B and liquid loop-B, and wherein said vapor loop-B is disposed above liquid loop-A and below intermediate loop-B with liquid loop-A being spaced from intermediate loop-B to define an open-air passageway therebetween, whereby said vapor loop-B is exposed to said open-air passageway.

7. The heat exchanger coil of claim 1, wherein at least some of said inner A-loops are substantially aligned horizontally to at least some of said outer A-loops.

8. A heat exchanger coil, comprising a circuit-A extending in a coiled configuration from a vapor loop-A to a liquid loop-A and being distributed to create a plurality of inner A-loops and a plurality of outer A-loops, wherein said circuit-A repeatedly transits between said plurality of outer A-loops and said plurality of inner A-loops, as said circuit-A runs from said vapor loop-A to said liquid loop-A, and a plurality of single layer loops operably connected to and adjacent said circuit-A.

9. The heat exchanger coil of claim 8, wherein said plurality of single layer loops is disposed at an upper portion of said heat exchanger coil.

10. The heat exchanger coil of claim 8, wherein said plurality of single layer loops is disposed at a lower portion of said heat exchanger coil.

11. A heat exchanger coil, comprising:

a circuit-A extending from a vapor loop-A to a liquid loop-A and being distributed to create a greater plurality of inner A-loops of a first width and a lesser plurality of outer A-loops of a second greater width; and a circuit-B in parallel-flow relationship with said circuit-A and extending from a vapor loop-B to a liquid loop-B, said circuit-B being distributed to create a greater plurality of inner B-loops of the first width and a lesser plurality of outer B-loops of the second width with said liquid loop-A being closer to said vapor loop-B than said vapor loop-A.

12. The heat exchanger coil of claim 11, wherein said inner A-loops are vertically staggered relative to said outer A-loops.

13. The heat exchanger coil of claim 11, wherein at least some of said inner A-loops are substantially aligned horizontally to at least some of said outer A-loops.

14. The heat exchanger coil of claim 11, wherein said circuit-A repeatedly transits between said plurality of outer A-loops and said plurality of inner A-loops, as said circuit-A runs from said vapor loop-A to said liquid loop-A.

15. The heat exchanger coil of claim 11, wherein said circuit-B repeatedly transits between said plurality of outer B-loops and said plurality of inner B-loops, as said circuit-B runs from said vapor loop-B to said liquid loop-B.

16. The heat exchanger coil of claim 11, wherein said circuit-B includes an intermediate loop-B adjacent vapor loop-B and disposed between vapor loop-B and liquid loop-B, and wherein said vapor loop-B is disposed above liquid loop-A and below intermediate loop-B with liquid loop-A being spaced from intermediate loop-B to define an open-air passageway therebetween, whereby said vapor loop-B is exposed to said open-air passageway.

17. A heat exchanger coil, comprising:

a circuit-A extending from a vapor loop-A to a liquid loop-A and being distributed to create a plurality of inner A-loops and a plurality of outer A-loops;

a circuit-B in parallel-flow relationship with said circuit-A and extending from a vapor loop-B to a liquid loop-B, said circuit-B being distributed to create a plurality of inner B-loops and a plurality of outer B-loops with said liquid loop-A being closer to said vapor loop-B than said vapor loop-A; and a plurality of single layer loops operably connected to and adjacent said circuit-B and disposed at an upper portion of said heat exchanger coil.

18. A heat exchanger coil, comprising:

a circuit-A extending from a vapor loop-A to a liquid loop-A and being distributed to create a plurality of inner A-loops and a plurality of outer A-loops; and a circuit-B in parallel-flow relationship with said circuit-A and extending from a vapor loop-B to a liquid loop-B, said circuit-B being distributed to create a plurality of inner B-loops and a plurality of outer B-loops with said liquid loop-A being closer to said vapor loop-B than said vapor loop-A; and a plurality of single layer loops operably connected to and adjacent said circuit-A and disposed at a lower portion of said heat exchanger coil.

19. A heat exchanger coil comprising:

a first vertically aligned row of spine fin tubing;

a second vertically aligned row of spine fin tubing; and circuiting to repeatedly transit the flow of a fluid between the first and second rows, wherein the pattern has a fluid flow sequence of three spiral loops in the first vertical row, one spiral loop in the second vertical row, two spiral loops in the first vertical row, and one spiral loop in the second vertical row.

20. The heat exchange coil of claim 19 wherein the circuiting moves the fluid in a first vertical direction.

21. The heat exchange coil of claim 20 wherein the circuitry does not move the fluid in a vertical direction substantially opposite the first vertical direction.

22. The heat exchange coil of claim 21 wherein the coil is a wound coil.

23. The heat exchange coil of claim 22 wherein the first and second rows include a plurality of spiral loops in a pattern.

24. The heat exchange coil of claim 19 wherein the spiral loops in the second vertical row have a greater diameter than the spiral loops in the first vertical row.

* * * * *